US006047831A

United States Patent [19]

Jones

[11] Patent Number: 6,047,831

[45] Date of Patent: Apr. 11, 2000

[54] SEALABLE ARTICLE PACKAGING KIT, SYSTEM AND METHOD

[75] Inventor: William Charles Jones, E. Sandwich, Mass.

[73] Assignee: Emerging Technologies Trust, Osterville, Mass.

[21] Appl. No.: 09/297,298

[22] PCT Filed: Oct. 28, 1997

[86] PCT No.: PCT/US97/19573

§ 371 Date: Apr. 28, 1999

§ 102(e) Date: Apr. 28, 1999

[87] PCT Pub. No.: WO98/18694

PCT Pub. Date: May 7, 1998

Related U.S. Application Data

[60] Provisional application No. 60/029,363, Oct. 28, 1996.

[51] Int. Cl.[7] ..... B65D 81/02

[52] U.S. Cl. ..... 206/591; 206/466; 206/521

[58] Field of Search ..... 206/461, 466, 206/497, 521, 583, 591, 594

[56] References Cited

U.S. PATENT DOCUMENTS

| | | | |
|---|---|---|---|
| 3,905,474 | 9/1975 | Haibara | 206/461 |
| 5,323,896 | 6/1994 | Jones | 206/583 |
| 5,676,245 | 10/1997 | Jones | 206/583 |
| 5,678,695 | 10/1997 | Ridgeway et al. | 206/583 |
| 5,967,327 | 10/1999 | Jones | 206/583 |

*Primary Examiner*—Jim Foster
*Attorney, Agent, or Firm*—Richard P. Crowley

[57] ABSTRACT

An article packaging kit, system and method which includes a stiff sheet material (30), with a base portion (49), with a longitudinal fold line (32), and foldable, longitudinal, opposing end portions (35, 37), and a film tube containing (28) a sealable envelop for the insertion and sealing of an article (40). The article is inserted and sealed in the envelope of the film tube, and is immobilized by the film material of the film tube on the base portion of the sheet material.

27 Claims, 7 Drawing Sheets

SEALABLE ARTICLE PACKAGING KIT, SYSTEM AND METHOD

REFERENCE TO PRIOR APPLICATIONS

This application claims the benefit of U.S. Provisional Application No. 60/029,363 filed Oct. 28, 1996, hereby incorporated by reference and the benefit of which filing date is requested.

BACKGROUND OF THE INVENTION

U.S. Pat. No. 5,323,896 issued Jun. 28, 1994, incorporated by reference, discloses an article packaging kit, system and method for the rapid and effective immobilization of an article on a base sheet, by a film tube, which hugs and immobilizes the article. The base sheet on which the article is immobilized has foldable end portions which permit the immobilized article to be packaged in a container with end portions folded to protect the article or to suspend the immobilized article above the bottom of the container.

It is desirable to provide a new and improved sealable article packaging kit, system and method whereby the article, particularly a dust-sensitive article, is effectively both sealed and immobilized within a packaging container.

SUMMARY OF THE INVENTION

The invention relates to a sealable article packaging kit, system and method for the protection and immobilizing of an article. In particular, the invention is directed to a sealable envelope film tube kit, system and method for the protection and immobilization, particularly of moisture, static or dust-sensitive, or odd-shaped, fragile articles, to be sealed, immobilized and placed within an outer container, which kit, system and method provides environmental advantages, simplicity and ease in manufacture and use.

The invention comprises a sealable packaging kit for the immobilization of an article to be packaged within a separate outer container or sealably displayed. The kit comprises a stiff sheet material, such as, for example, but not limited to: a paper or corrugated cardboard sheet material of defined width and length, and which sheet material has a base portion, with at least one longitudinal fold line, generally centrally positioned, and generally dimensioned to immobilize an article within an envelope film tube. The sheet material includes end portions, defined by traverse fold lines, which may be the same or different length on opposite sides of the base portion, and which end portions are adapted to be folded away from the plane of the base portion, for example, generally perpendicularly upwardly, or angularly upwardly and downwardly from the base portion, and at either end of the base portion.

In one embodiment, the sheet material may have a generally central, longitudinal fold line or in another embodiment, the sheet material may have a generally parallel pair of longitudinal fold lines toward opposite edges of the sheet material. Generally and preferably, the longitudinal fold lines extend substantially the length of the sheet material to include the opposing end flaps. The sheet material includes at least one pair of opposing, foldable end portions defined by traverse fold lines. However, multiple end portions, at each end, may also be formed and used by multiple, generally parallel, traverse fold lines.

The end portion may be folded upwardly about the sides of the immobilized article for article protection, or more typically, folded downwardly, in single or multiple arrangements, to suspend the immobilized article on the base portion above the bottom of the container. The sheet material, optionally, may also include similar, traverse, opposing, end portions for similar purposes, in combination for use with the opposing, longitudinal, end portions. The end portions generally, but not necessarily, are equal in width to the width of the base portion, and may vary in length, as required, that is, may be equal in length, or different in length, such as, for display purposes where the sealed, immobilized article is inclined for securing purposes.

The invention also includes an envelope film tube or sleeve means, formed completely or partially of thin, plastic film, typically transparent, and dimensioned and adapted to be positioned and loosely fit, such as slidably, about the sheet material and particularly the base portion thereof, in a generally loose-type fit when the sheet material is in a nonuse position, or a film tube wherein a thin film material has opposing, longitudinal edges glued or secured to opposite side edges of the base portion on a face surface to fit closely in a huggable film-type manner about the article on the base portion in an article immobilization position.

The invention comprises the film tube or sleeve means to include or form a sealable envelope or pouch as a part of the film tube or sleeve means usually on the face of the base portion, whereby one or more articles, particularly moisture, dust or static sensitive articles to be immobilized on the base portion may be placed in the envelope and readily sealed in place either before or after the article is placed in the article immobilization position. The sealable envelope may have one or both ends or sides open and be sealable and may be formed, in one embodiment, by securing the edges together of multiple layers of the film material to form a slidable film tube, or in another simple embodiment, an envelope or pouch may be secured, by adhesive, at the longitudinal edges of the base position to act as film tube, both as a sealable, film envelope and as the huggable film material to immobilize the article in the base position.

In one embodiment, the film tube may be formed of a first and second sheet of sealable plastic film, said first and second sheet of equal width, and said second sheet being greater in length, for example, more than twice the length of said first sheet. To form the film tube, the second longer sheet is folded over lengthwise to provide a folded sheet with a top and bottom section, the bottom section being of greater length than the top section. The first sheet is then placed below the folded over second sheet and the sheets are sealed, i.e., heat-sealed, along their outer length edges to provide for a three layer film tube having an envelope or pocket with one open end formed from the folded over second sheet, with the slightly longer portion of the second sheet extending from the three layer tube and providing for a sealable flap for the film tube envelope. The flap has an adhesive, sealing means extending along its entire width to enable the flap to be closed over the film tube envelope, and provide protection for an article or articles inserted within the envelope while in another embodiment, the envelope may be sealed without the use of adhesives or tape by the flap tucked over the article end and into the open end of the envelope.

In a simple embodiment of the invention, a separately formed envelope or pouch of plastic material, with a sealable opening, may be sealed at one or more points onto the slidable face surface of a film tube. After the insertion of an article or articles in the envelope and the sealing thereof, the film tube, comprised of the plastic film sheet and the plastic film envelope, may be used with the sheet material of the packaging kit. The kit permits the sealed article, within the envelope film tube, to be positioned over the central base portion of the sheet material when the sheet material is in the folded article-insertion position for the positioning of the envelope-enclosed article on the base portion, and then when the end portions are folded, the sheet material is returned to a generally flat, planar position by the movement of the end portions, and which movement then immobilizes the article on the base portion by causing the film material of the film tube or sleeve means to stretch over the sealed article or articles being immobilized to hold the sealed article or articles in place on the base portion in a close, article-immobilizing fashion. The upward movement of the end portions on vertical fold lines causes the horizontal fold line or lines to flatten out on the sheet material, which in turn causes the sleeve or tube to stretch over the article being packaged and to be immobilized in place as in U.S. Pat. No. 5,323,896. Optionally, the kit of the invention includes an outer packaging container of defined dimension, but typically having a base of similar dimension as the base portion in which the immobilized article with the sheet material may be inserted.

The envelope or pouch provided or integrally formed in the film tube or sheet means should be sealable to protect and enclose the article to be immobilized. The envelope may have generally equal sides or have one or both sides longer in length than the base portion to provide one or more flap portions. The envelope includes a means to seal the one or both longitudinal, open ends of the envelope; such as, but not limited to; the employment of temporary, releasable or permanent seals like adhesive tape; heat seals; glue; adhesives; Velcro® closures (opposing hook and loop fabrics); interlocking closures; and merely tucking a flap portion inwardly in the envelope to encompass and close one end of the article. The nature and extent of the means to seal, to be used for the envelope, depends in part on the nature and degree of sealed protection required by the article to be sealed and immobilized. Where highly dust, moisture, and static sensitive articles are to be sealed, such as electronic equipment, like a laptop computer, then the means to seal should provide a more effective dust and moisture seal, such as the use of heat seals or opposing, removable, adhesive tape at the inside edges of the open end of the one open end of an envelope.

In a further embodiment, a sealable pouch of film material may be secured, such as by glue or adhesive, to the underlying longitudinal edges of the base portion of the sheet material, rather than the face surface. The pouch should have a width slightly greater than the width of the base portion, to permit each edge to be uniformly folded under and then secured, generally, by the use of self-adhesive strips along the opposite bottom edges of the pouch. The open end of the pouch may be separately sealable or have an extended end flap with a glue line and a removeable protective strip, e.g., paper, so that the flap can be adhesively sealed. The film tube formed with the sealable pouch and sheet material is sized and positioned, so that when the sheet material is folded along the central, longitudinal fold line, the film tube is loose and an article may be inserted in the pouch and sealed, and when the opposite end portions are folded, the film material of the pouch tightens, and the film tube face hugs and immobilizes the sealed article in the base portion.

The invention includes a method for the sealed protection and immobilization of one or more articles for packaging, within an outer container, which method includes inserting one or more articles within a sealable envelope film tube or sleeve means, over the base portion, sealing the article in the envelope, and then folding the end portions of the sheet material upwardly or downwardly, or a combination thereof, to a use, or non-flat position, such as, generally perpendicularly from the plane of the base, on the first and second vertical fold lines, in order to place the sheet material in a generally flat position, and to cause the film tube means to move inwardly against the inserted and protectively sealed articles, and to stretch and to hug, and thereby immobilize the article on the base portion of the sheet material.

The system of the invention includes a packaging container, containing therein one or more of the sealed, immobilized articles on the base portion and placed within the container. The system also includes displaying the sealed, immobilized article on the base portion, when the end portions are used as a base for display, and the film material comprises a transparent film material. The packaging container may include, as described, other packing material, such as foam, particulate foam packaging material, packing paper, and the like for further protection purposes, since the article is sealed and immobilized.

The present invention offers many and substantial advantages over prior art packaging kits, systems and methods, for example, and not to be limited to; the employment of minimum, pre-use, storage space since the items, that is, the sheet material and the film tube or sleeve means, may be stored together or separately in a flat condition for high density storage. The invention permits a universal application, since the envelope film tube means may be adapted to contain one or more of a variety of articles to be packaged and pack a variety of different articles of regular or odd shapes, reducing substantially the inventory of packaging materials required where there are a number of articles to be packaged. The kit, system and method of the present invention is environmentally acceptable and sound and can be made, if required, of recyclable film, such as, for example, recycled polyethylene or other flexible, plastic film and corrugated or paper-type material, such as reusable corrugated cardboard.

The envelope film tube may be sealed with a removably, securable adhesive to allow for reuse, wherein the sheet material can be folded down easily and the immobilized article removed by opening the releasably secured seal, opening the envelope, and then removing the article from the envelope, and therefore the envelope film tube means and the sheet material may be then saved for later reuse. Further, if desired, the non-releasably, secured opening may be cut on the outer edge to open the envelope, thus providing for a simple sleeve means for reuse with the sheet material, or the envelope pocket used without a closure.

The present system is clean, easy to use and protects the article or articles to be shipped from the disadvantages of being employed in direct contact with loose particles, foam-type material and foam-in-place packaging systems, which might damage or affect an unsealed article, and does not present any disposal problems, as the components may be made of low-cost, easily disposed of, recyclable components. The present invention envelope containing film tube means, when not secured to a sheet material, such as a corrugated board, may be easily recycled without separation, while the present apparatus, system, and method provides a combination of various films of plastic, non-plastic, foam or air bubble plastic films with various sheet materials to be used, and therefore allows for a wide range of applications of sheet and tube materials to the kit, system and method.

The envelope film tube or sleeve means employed with the stiff sheet material to form the kit of the invention can be selected from a wide variety of material, but generally is comprised of material that typically would include, but not be limited to, a wide variety of heat-sealable, flexible, slightly stretchable, tear-resistant, plastic, film-type materials, such as, for example, olefinic, vinyl and urethane-type mono or multiple layer films, more particularly with the polyethylene or recycled polyethylene-type film formed into a sleeve or tube and preferably transparent or translucent film material. The film thickness may vary as desired, and generally, for example, may range from one to ten or more mils, and generally should be selected to be slightly stretchable, tear-resistant and low slip, so it may be slidably and easily placed over the base portion, where an integral film tube with an envelope is used. The use of plastic film provides protection from dust, moisture or other environmental pollutants.

The film material may be heat or adhesively sealable, so that the film material may have opposing, longitudinal edges secured on each side of the base portion and extend generally the length of the base portion, to form a film tube with the face surface of the base portion. The film material may include moisture-impermeable film material, such as, extended multiple layer film material, or film material which has been treated or contains additives to be anti-static or static-dissipative or film material which is opaque, transparent or translucent, or film material which is adhesively or heat-sealable or a recyclable film material or any combination of such properties.

Representative, illustrative examples of suitable film materials include homo and copolymeric olefins, like polyethylene and ethylene-maleic, anhydride copolymers, metallocene catalyzed polyethylene, or thermoplastic, ultra low density polyethylene.

The film tube may comprise a slidable, multilayer, film tube with one or both ends open, wherein the article or articles to be immobilized are placed in between one or more of the multiple layers of the film tube above the base portion. The multilayer film tube may have separate non-extended or extended sealing flaps at one or both ends as desired, or may have no sealing flap with the article or articles within the layer sealed in place by the separate application of sealing tape or adhesive.

In one preferred embodiment, the multilayered film tube is open at both ends, the article inserted between film layers and the ends sealed, for example, by making the film tube larger than the base portion length, so that on movement of the end portion out of the base portion, the film tube is gathered together at each end to seal the article within the tube and the multilayer film tube may be integrally formed or formed by the application of an adhesive, e.g., pressure-sensitive adhesive, or heat-sealed to opposite edges. The multilayers may be only formed on the top of the film tube over the base portion or be multiple layers on both sides.

The kit, optionally, would include the outer container in which the immobilized article on the sheet material may be inserted and then be contained, sealed and shipped. Additional dunnage or other packaging material may be inserted on top of or about the immobilized article for further protection, as required, without damage to the environmentally-sensitive article or articles inside the sealed envelope. The method of the invention is particularly useful wherein one or more particle or dust-sensitive, odd-shaped, fragile-type articles need to be securely immobilized for package and shipment, such as, electronic components, computer equipment or other types of fragile, delicate, and/or odd-shaped articles.

The invention will be described for the purposes of illustration only in connection with certain preferred embodiments; however, it is recognized that those persons skilled in the art may make various modifications, changes, improvements, and additions to the illustrated embodiments without departing from the spirit and scope of the invention.

DESCRIPTION OF THE EMBODIMENTS

FIGS. 1–5 are directed to one embodiment of the packaging kit 10 of the invention.

Figure 1:
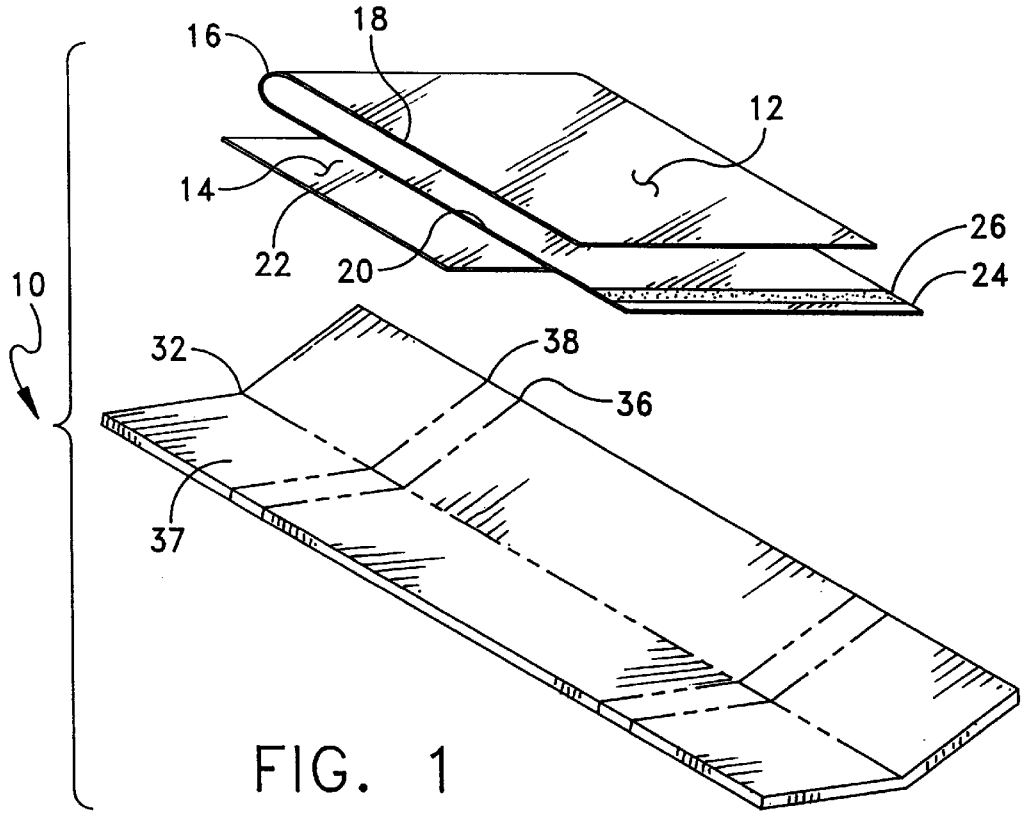
FIG. 1 is a perspective, exploded view, from above, of two plastic film sheets prior to heat-sealing and forming a film tube with a sealable envelope.

FIG. 1 shows thin thermoplastic sheet material of the kit 10 in a non-assembled configuration, to prepare a film 10 tube, with first sheet 14 and second sheet 12, e.g., 2–4 mil transparent, polyethylene sheet in a stacked, layered position, with the longer second sheet 12 folded over to make a fold 16 at one end and an overlap portion 24 with a layer of an adhesive 26 thereon at the opposite end. Outside length edges 18, 20, and 22 are positioned to be heat-sealed together to form the completed, three-layer, envelope film tube with a one open end in the formed envelope 28. The kit 10 includes a cardboard sheet material 30 with a central, longitudinal fold line 32 and with opposite end portions 35 and 37 defined by traverse fold lines 36 and 38.

Figure 2:
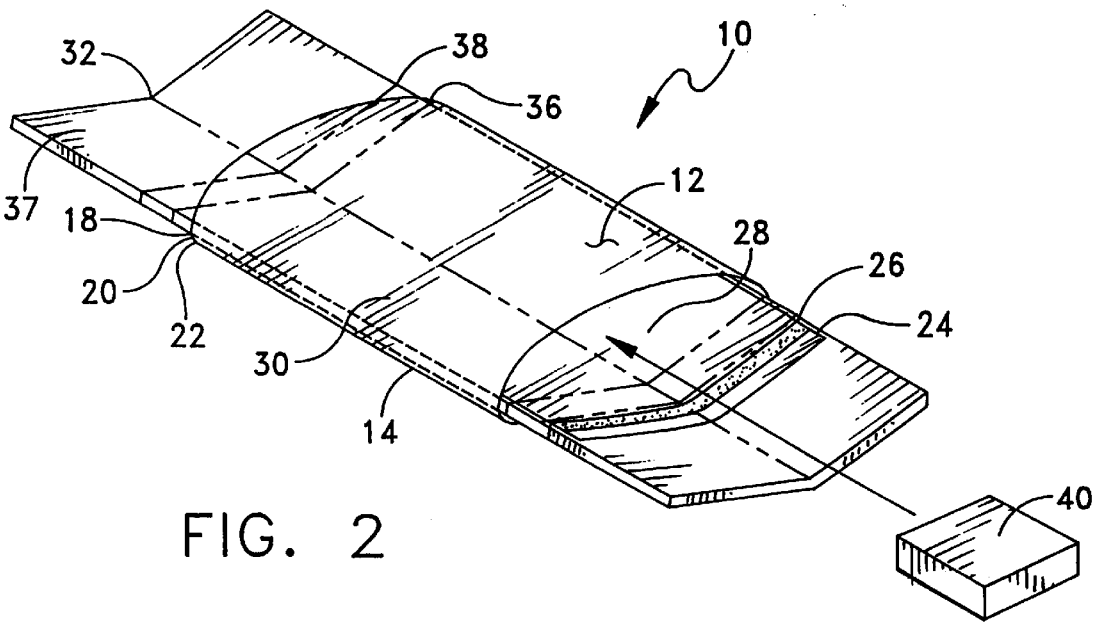
FIG. 2 is a perspective view, from above, of an article packaging kit with the plastic film sheets of FIG. 1 heat-sealed to form an envelope film tube, the sheet base portion inserted within, and an environmentally-sensitive article prior to insertion within the envelope.

FIG. 2 shows an article packaging kit 10 with the formed envelope film tube 28. The drawing illustrates sheet base material 30 folded at central fold line 32 and slidably inserted within the envelope film tube 28. An environmentally-sensitive article 40 e.g., a laptop computer, is positioned and illustrated by arrow to be inserted within the envelope 28 formed by the folded over second sheet 12, which sheet is heat-sealed at the outer length edges 18 and 20 to outer length edges 22 of first sheet 14 to from the slidable film tube over the sheet material 30.

Figure 3:
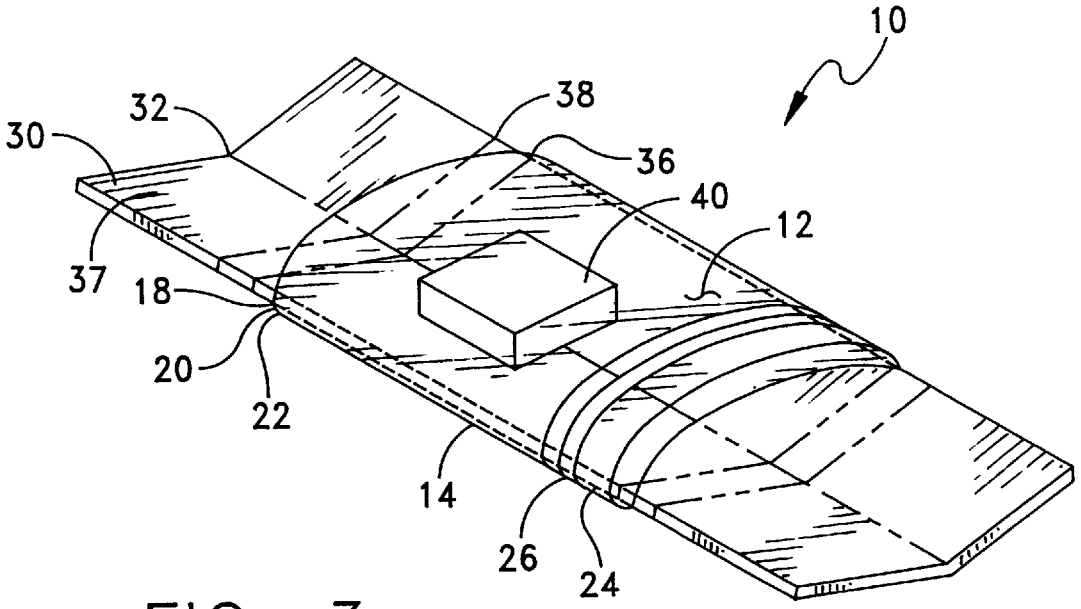
FIG. 3 is a perspective view, from above, of the article packaging kit of FIG. 2 with the article inserted within the envelope and the envelope sealed, prior to an immobilization position.

FIG. 3 shows the article packaging kit 10 with the environmentally-sensitive article 40 inserted within the envelope film tube 28 on top of the film tube being sealed by adhesive 26 on flap 24 to form protective seal 38 for the article 40.

Figure 4:
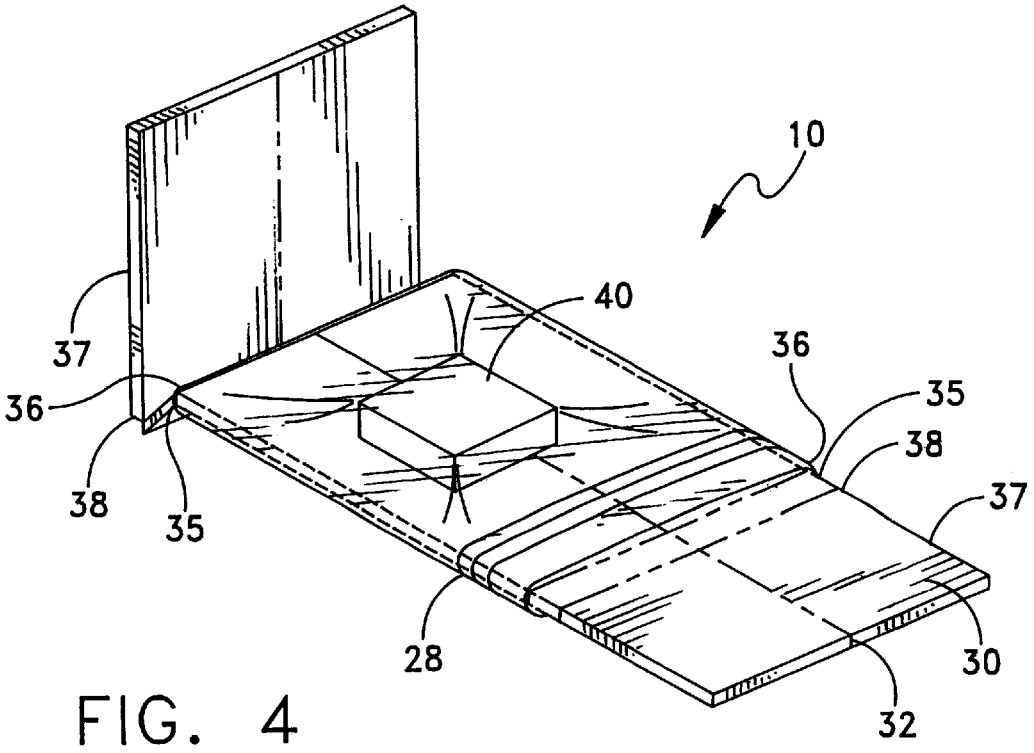
FIG. 4 is a perspective view, from above, of the article packaging kit of FIG. 3 in an article sealed and immobilized position, prior to being placed in a container for shipping.

FIG. 4 shows the packaging kit 10 with an article 40, within the sealed, protective film tube 28, and positioned and immobilized on the base portion of the sheet material 30 which is now in the planar, article-immobilizing position, due to the folding of end portions 35 and 37 at fold lines 36 and 38. The raised end portion 37 provides for further protection of the sealed article that requires protection from dust or other environmental pollutants, and immobilizes the article for placing in a shipping container.

Figure 5:
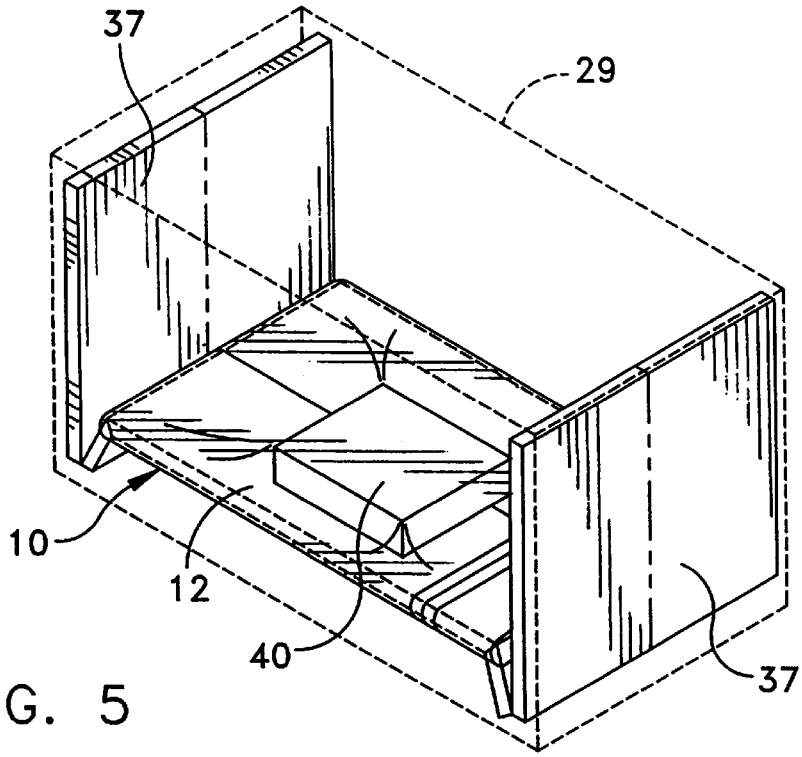
FIG. 5 is a perspective view of the sealed, immobilized article of FIG. 4 within a container shown in dotted lines.

FIG. 5 illustrates the sealed, immobilized article 40 on the base portion 30, within the sealed film tube envelope 28, and within a shipping-packaging container 29 shown in dotted lines. The end portions 37 are folded upwardly to provide further end protection to the sealed, immobilized article 40, which intermediate end portion is folded downwardly and against an adjacent portion of end portion 37, to support and suspend the base portion 30 with the article 40 above the bottom of the container 29.

Figure 6:
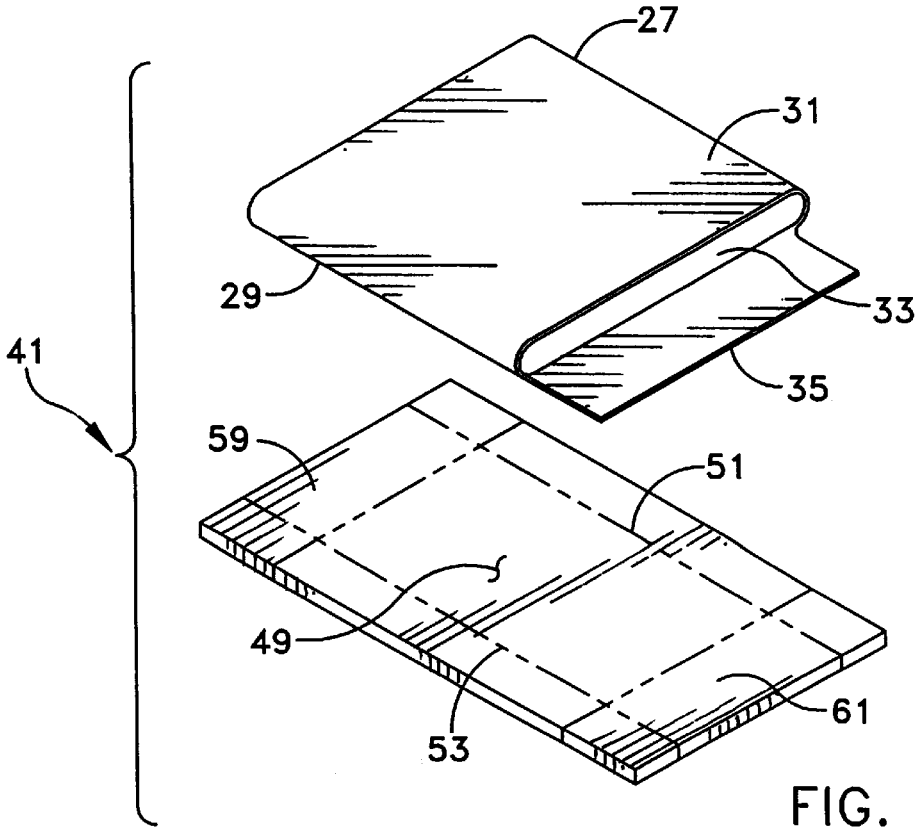
FIG. 6 is an exploded, perspective view, from above, of another packaging kit of the invention.

FIG. 6 illustrates another embodiment of the kit 41, which shows a cardboard sheet material with a base portion 49, with a pair of longitudinal fold lines 51 and 53 toward each longitudinal, side edge of the base portion 49 and with opposite, foldable, end portions 59 and 61. A transparent, polyethylene film material forms an envelope 31, having an open end 33 and an extended, foldable flap 35. FIG. 6 shows the kit 41 with the longitudinal edges 27 and 29 of the envelope 31 sealed by an adhesive or heat-sealed to the outside edges of the base portion 49.

Figure 7:
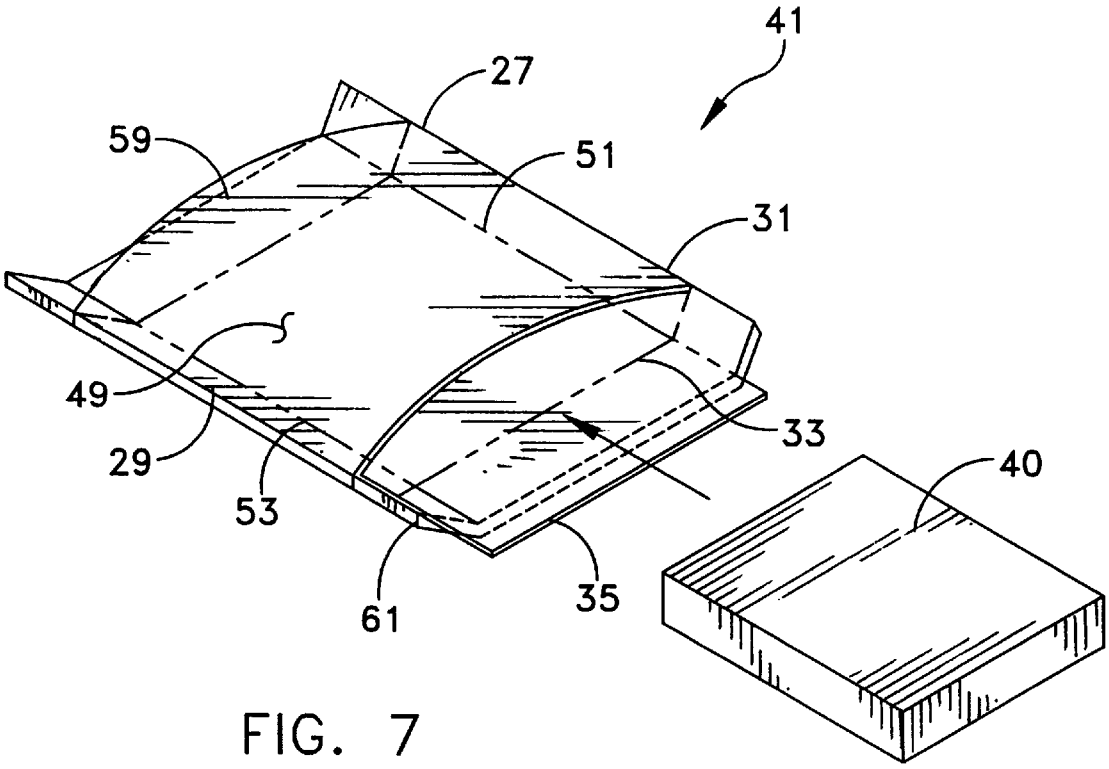
FIG. 7 is a perspective view, from above, of FIG. 6 with the article to be inserted.

FIG. 7 shows the edges of the base portion 49 folded along longitudinal fold lines 51 and 53 to permit the insertion of article 40, shown by an arrow within the envelope 31, having its edges sealed to the edges of the base portion 49 to form, with the face surface of the base portion, a film tube.

Figure 8:
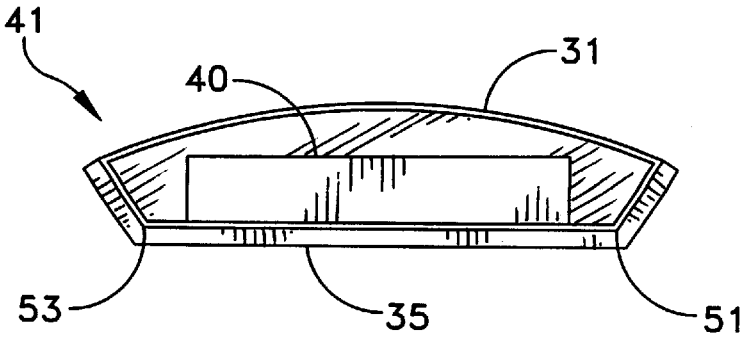
FIG. 8 is a section end view of the one end of the kit of FIG. 7, prior to sealing and immobilization of the article.

FIG. 8 illustrates an end view of the kit 41 of FIG. 7 with the article 40 inserted into the envelope 31 prior to sealing.

Figure 9:
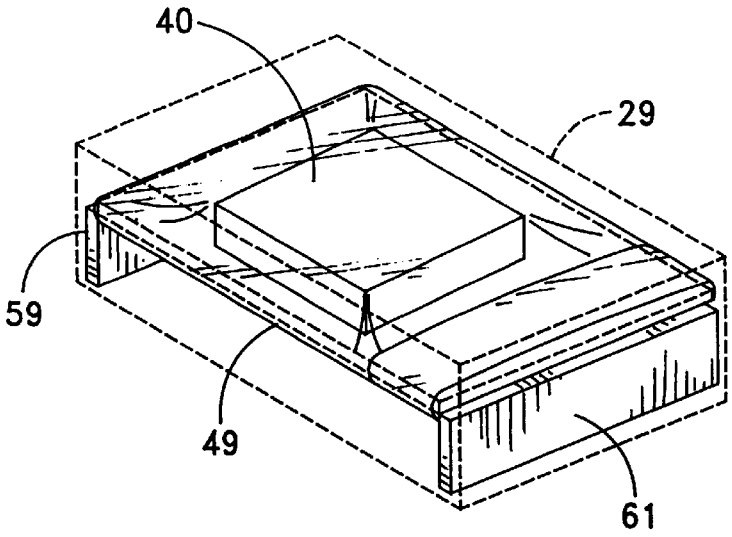
FIG. 9 is a perspective view, from above, of the kit of FIGS. 7–8 with the article sealed and immobilized.

FIG. 9 shows the article 40 sealed in the envelope 31, by tucking the extended flap 35 within the open end 33 and under the article 40, and the article 40 immobilized by the hugging of the polyethylene film about the article 40, and with the opposite end portions 59 and 61 folded downwardly, so as to suspend the base portion 49, with the article 40, a defined height above the bottom of a packaging container (not shown).

As described and illustrated, the envelope film tube used in the packaging kit, system and method permits the sheet material and the envelope containing film tube to be stored flat for high density storage, and permits for a universal application, since the envelope film tube may be stretched over the article being packaged, and one kit could package a variety of items, or the kit can be produced in various sizes to cover a wide variety of packaging items. The kit components are environmentally acceptable and sound, since they can be made from recycled, plastic, film material and the sheet material may constitute a stiffened paper or corrugated, reusable cardboard. Further, the packaging kit components may be separately removed by placing the kit components in the article receiving position, and recovering the envelope film tube and the sheet material, while the kit components are easily recyclable, in one embodiment, since there is no attachment of the slidable, envelope film tube to the sheet material, except in the outstretched position of the article immobilizing position.

Figure 10:
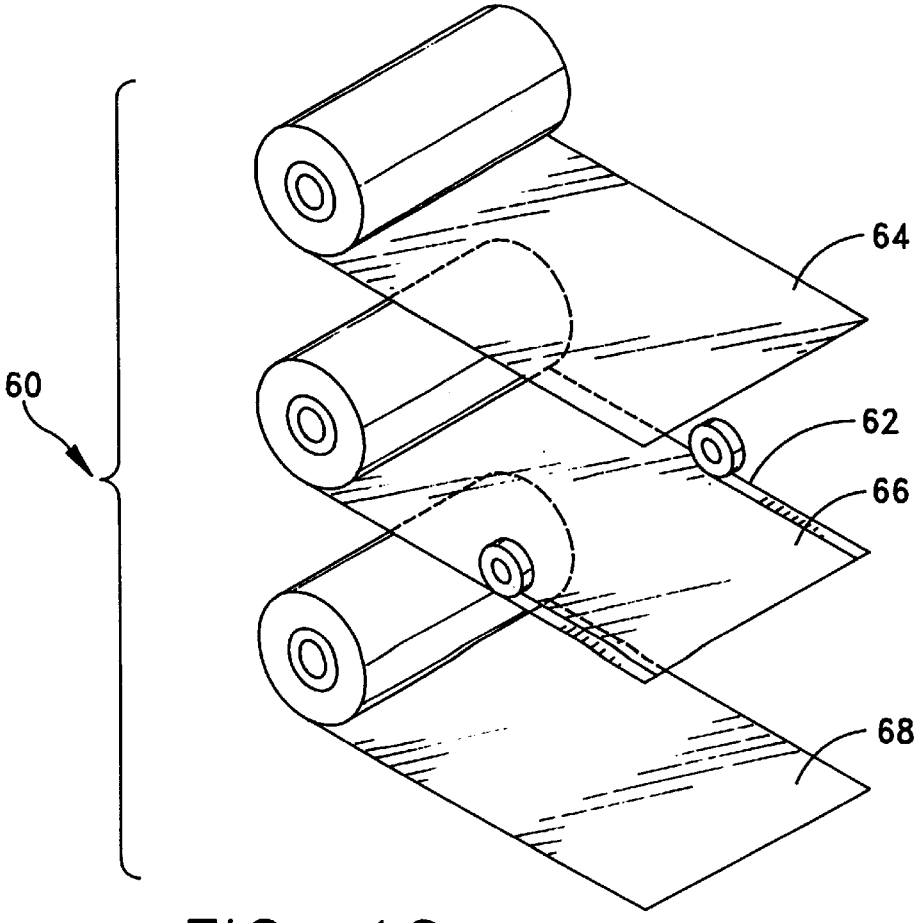
FIG. 10 is an exploded, perspective view, from above, of a multiple layer film sheet material tube formed prior to being adhesively sealed by tape.

FIG. 10 shows an exploded, perspective view, from above, of a multiple layer film sheet 60, adhesively sealed by tape at outer edge 62, with the top 64, middle 66 and bottom layer 68 sealed together to form a sealable film tube, prior to the insertion of a base sheet material within the film tube.

Figure 11:
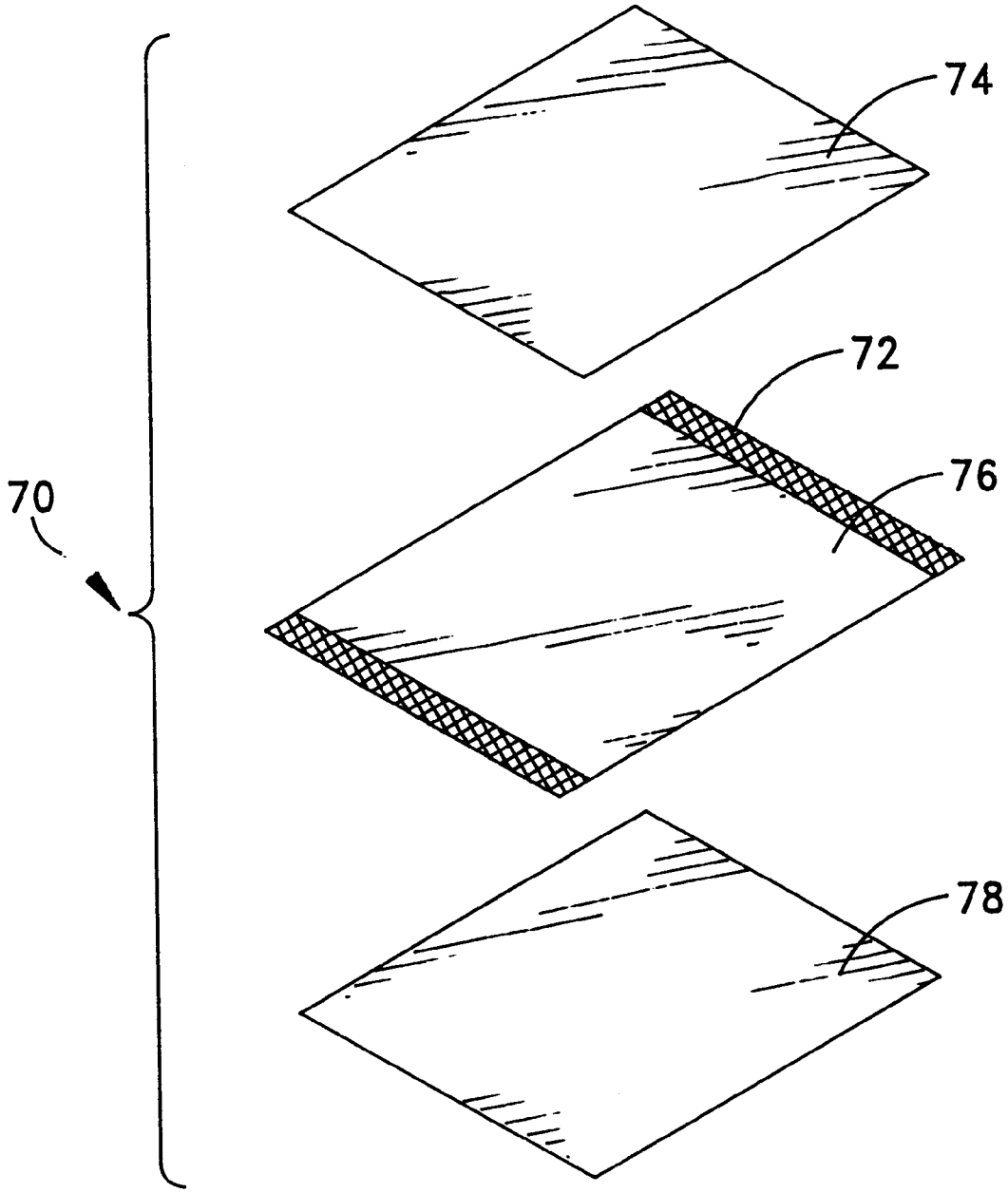
FIG. 11 is an exploded, perspective view, from above, of a multiple layer film sheet material, prior to being heat-sealed on the outer edges, to form an integral, multiple layer film tube.

FIG. 11 shows an exploded, perspective view, from above, of another method of forming an envelope containing a slidable, film tube, for use with a sheet material a with multiple layer film sheet material 70, prior to being heat-sealed on the outer edges 72 to form an integral, multiple layer comprised of a top 74, middle 76 and bottom 78 sheets.

Figure 12:
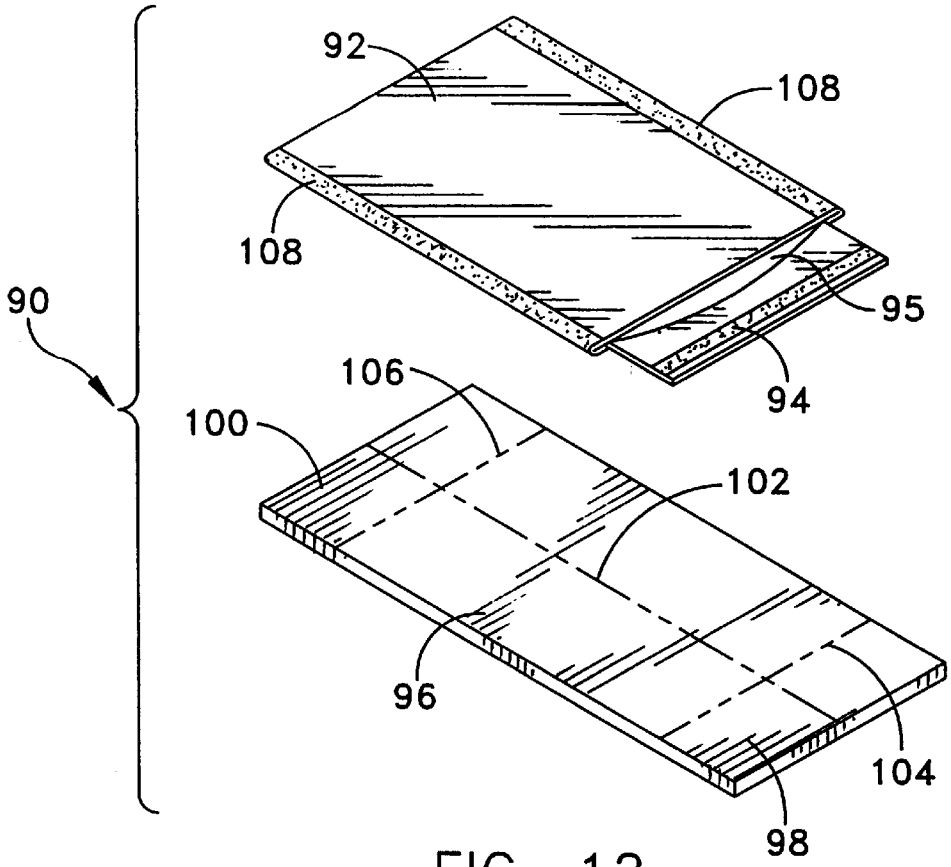
FIG. 12 is an exploded perspective view, from above, of another embodiment of a kit.
Figure 13:
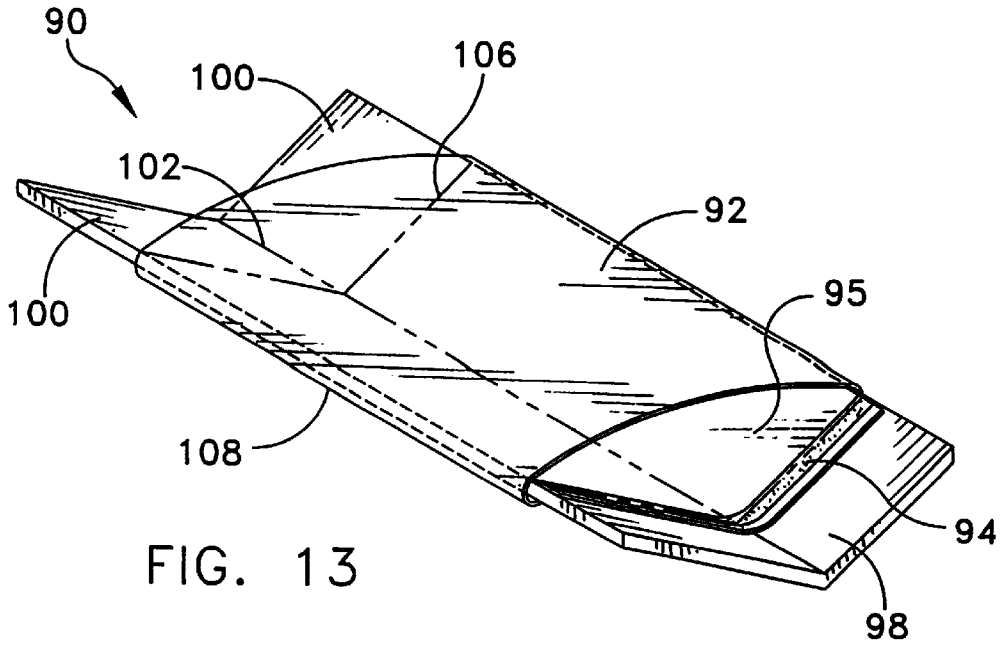
FIG. 13 is a perspective view of the kit of FIG. 12 in an article insertion position.

Another embodiment of the invention is shown in FIGS. 12 and 13 wherein the kit 90 includes a sealable, polyethylene film pouch 92 having an open end 95 for the insertion of an article, with an end flap 94 with a self-adhesive, sealing line or edge (optionally, with a removable protective tape, not shown). The pouch 92 includes an adhesive strip 108 along the underside of both longitudinal edges. The kit 90 includes a cardboard sheet material with a base portion 96 with a central, longitudinal fold line 102, and opposite end portions 98 and 100 with the traverse fold lines 104 and 106. The width of the rectangular pouch 92 is slightly wider than the width of base portion 96, but substantially the same length. The pouch 92, with edges 108, extends over the opposite, longitudinal edges of 96, and are glued or otherwise secured to the longitudinal underside of the base portion 96. This arrangement permits the sheet material to be folded inwardly along fold line 102 with the pouch 92 secured to the face surface of 96, with an open end for the article to be inserted and then sealed in the pouch by the self-adhesive line or edge to the outside edge of the pouch 92, and the sheet material placed in a flat position to immobilize the sealed article, and then end portions 98 and 100 bent downwardly for insertion of the sealed, immobilized article in a container (not shown).

Thus, the article sealing and packaging material of the invention may be used in a wide variety of ways, for single and multiple articles in a packaging kit and system that provides for flexibility in use and added sealed protection for a fragile and/or environmentally-sensitive article or articles to be shipped.

What is claimed is:

1. A packaging kit for the sealing and immobilizing of an article, which kit comprises:

a) a relatively stiff sheet material, of defined length and width, having a base portion with a face surface to hold the article, and characterized by at least one, longitudinal, fold line along its length, and having opposite, longitudinal, end portions defined by traverse fold lines, the end portions adapted to be folded out of the plane of the base portion, the sheet material adapted to move between a first, generally planar non-use position; a second, folded, article insertion position; and a third, generally planar, article immobilizing use position;

b) a film tube comprised, at least in part, of a thin, huggable, plastic, film material which loosely extends over the face surface, in the nonuse position, and adapted to hug and hold the article in the article immobilizing use position, the film tube comprised of at least two layers of film material, and to form a sealable envelope with at least one end or side opening and adapted for the insertion within the envelope of the article to be sealed; and c) means to seal the article within the envelope, whereby the article is both sealed and immobilized on the base portion of the sheet material.

2. The kit of claim 1 wherein the envelope includes, and the means to seal includes, an extended flap extending from the opening, the flap adapted to be tucked within the envelope to seal the article therein.

3. The kit of claim 1 wherein the envelope includes an opening at one or both opposing ends.

4. The kit of claim 1 wherein the means to seal comprises an adhesive seal, a tape seal, a heat seal, a hook-loop seal, and an interlocking seal.

5. The kit of claim 1 wherein the film tube comprises three layers of film material, sealed along the longitudinal edges of the film material, to form an envelope having a one opening sealable end, the film tube slidably positioned over the base portion.

6. The kit of claim 1 wherein the film tube comprises an envelope having a one open end to define the opening, and having longitudinal edges of the envelope secured to longitudinal edges of the base portion, to form a secured non-slidable film tube.

7. The kit of claim 1 wherein the means to seal comprises at least one traverse layer of an adhesive extending across and adjacent the open end of the opening of the envelope.

8. The kit of claim 1 wherein the film tube comprises a first film and a second elongated, generally rectangular, film material at least twice the length of the first film material, the longitudinal edges of the first and second film materials sealed together to form a slidable film tube with an envelope having an opening at one end.

9. The kit of claim 1 wherein the sheet material is characterized by a central, longitudinal fold line which extends substantially the length of the sheet material.

10. The kit of claim 1 wherein the sheet material is characterized by a pair of spaced apart, generally parallel, longitudinal fold lines, each generally, uniformly positioned toward each longitudinal edge of the base portion.

11. The kit of claim 1 wherein the opposing end portions comprise at least a pair of foldable end portions at each end of the sheet material.

12. The kit of claim 1 wherein the film tube comprises a layer of film material which extends below the face surface and at least two, edge-sealed layers to form the envelope which extends over the face surface.

13. The kit of claim 1 wherein the film tube comprises a sealable envelope having an open, sealable end for the insertion of an article, and opposite longitudinal edges, and the envelope having a width greater than the width of the base portion, and the opposite longitudinal edges secured to the bottom surface of the base portion.

14. A packaging system which includes the kit of claim 1 and which includes a container for the insertion of the sealed, immobilized article.

15. The system of claim 14 wherein the end portions are folded out of the plane of the base portion to suspend the sealed article immobilized on the base portion above the bottom of the container.

16. The kit of claim 1 which includes the sealed, immobilized article on the base portion.

17. The kit of claim 16 wherein the article comprises a moisture, dust or static-sensitive, electronic article.

18. The kit of claim 1 wherein the sheet material comprises a generally rectangular, cardboard material, the film material comprises a transparent plastic film material, and the film tube with the envelope extends, generally, over the entire face surface of the base portion.

19. A method for the sealing and immobilizing of an article, which method comprises:

a) providing a relatively stiff sheet material, of defined length and width, having a base portion with a face surface to hold the article, and characterized by at least one longitudinal, fold line along its length, and having opposite, longitudinal, end portions defined by traverse fold lines, the end portions adapted to be folded out of the plane of the base portion, the sheet material adapted to move between a first, generally planar non-use position; a second, folded, article insertion position; and a third, generally planar, article immobilizing use position; and a film tube comprised, at least in part, of a thin, huggable, plastic, film material which loosely extends over the face surface, in the nonuse position, and adapted to hug and hold the article in the article immobilizing use position, the film tube comprised of at least two layers of film material, and to form a sealable envelope with at least one end or side opening and adapted for the insertion within the envelope of the article to be sealed;

b) inserting the article to be sealed and immobilized into the envelope through the opening;

c) sealing the opening to seal the article in the envelope; and d) moving the sheet material between the insertion position to the article immobilizing position.

20. The method of claim 19 which includes sealing the article in the envelope by tucking an extended flap at the opening about an end of the article in the envelope or within the envelope.

21. The method of claim 19 which includes sealing the article in the envelope by an adhesive or sealing tape at the opening.

22. The method of claim 19 which includes forming an envelope, substantially to mimic the dimension of the face surface, and having an opening at one longitudinal end.

23. The method of claim 19 which includes folding the end portion out of the plane of the sheet material, and inserting the sealed, immobilized article in a container with the base portion suspended above the bottom of the container by the folded end portions.

24. The method of claim 19 which includes forming the envelope with a sealable opening by securing a sealable envelope onto one surface of a slidable film tube.

25. The method of claim 19 which includes forming a film tube employing a first film material and a second film material, at least twice the length of the first film material, folding over the second film material and sealing the edges of the first and second folded-over, film material to form a film tube with an envelope, with one open, sealable end.

26. The method of claim 19 which includes providing a sealable envelope with an open end for the insertion of an article, having opposite longitudinal edges, and a sealable open end, and the envelope having a width greater than the width of the base portion, and securing the opposing, longitudinal edges to the bottom surface of the base portion.

27. The sealed and immobilized article on the base portion produced by the method of claim 19.

* * * * *